US009235998B2

(12) United States Patent
Sitton

(10) Patent No.: US 9,235,998 B2
(45) Date of Patent: Jan. 12, 2016

(54) CIRCULARLY FOLDABLE DAISY DISPLAY STAND

(71) Applicant: Oren Sitton, Ness-Ziona (IL)

(72) Inventor: Oren Sitton, Ness-Ziona (IL)

( * ) Notice: Subject to any disclaimer, the term of this patent is extended or adjusted under 35 U.S.C. 154(b) by 27 days.

(21) Appl. No.: 14/158,905

(22) Filed: Jan. 20, 2014

(65) Prior Publication Data

US 2014/0205772 A1 Jul. 24, 2014

Related U.S. Application Data

(60) Provisional application No. 61/754,659, filed on Jan. 21, 2013.

(51) Int. Cl.
*G09F 15/00* (2006.01)

(52) U.S. Cl.
CPC ..... *G09F 15/0062* (2013.01); *G09F 15/0031* (2013.01)

(58) Field of Classification Search
CPC ..... G09F 15/0031; G09F 15/0037; G09F 15/0062
USPC ..... 40/539, 607.03, 606.12
See application file for complete search history.

(56) References Cited

U.S. PATENT DOCUMENTS

| | | | | | |
|---|---|---|---|---|---|
| 1,028,147 | A * | 6/1912 | Stranders | 40/539 |
| 3,203,124 | A * | 8/1965 | Stoessel | 40/605 |
| 4,302,897 | A * | 12/1981 | Deckys | 40/605 |
| 4,334,683 | A * | 6/1982 | Campbell | 273/126 R |
| 5,000,717 | A * | 3/1991 | Pfeiffer | 446/488 |
| 6,269,570 | B1 * | 8/2001 | Miles | 40/607.03 |
| 7,634,865 | B2 * | 12/2009 | L'Hotel | 40/610 |

* cited by examiner

*Primary Examiner* — Gary Hoge
(74) *Attorney, Agent, or Firm* — Perel—Intellectual Property Law

(57) ABSTRACT

A circularly folding display stand that includes a plurality of sector-like partitioned, that can be compressed into storage mode by folding the partitions together to minimize sector area, and can be opened into a display mode by opening the partitions to maximize sector area.

20 Claims, 13 Drawing Sheets

CIRCULARLY FOLDABLE DAISY DISPLAY STAND

RELATIONSHIP TO EXISTING APPLICATIONS

The present application claims priority from US provisional application for a patent No. 61/754,659, filed in Jan. 21, 2013, the contents of which are hereby incorporated by reference.

FIELD OF THE INVENTION

The present invention relates to display stands, and, more particularly, but not exclusively, foldable plastic-board stands.

BACKGROUND OF THE INVENTION

Display systems made of plastic material are known in the art. These systems are usually made from plastic boards. These boards feature flexibility that allows bending as well as folding. To save on transportation volume, plastic boards display system are assembled on site, which is time-consuming and requires training. Erroneous assembly creates a shaky display system that eventually collapses under the weight of the displayed items. There is thus a widely recognized need for, and it would be highly advantageous to have a method and a system for foldable display system devoid of the above limitations.

SUMMARY OF THE INVENTION

According to one aspect of the present invention there is provided a folding display stand including a plurality of folding partitions, each partition including a foldable vertical rear plate, a flexible vertical front plate, and a foldable horizontal display plate; where the partitions are joined side-by-side by their vertical rear plates; whereby the folding display stand can be compressed into a storage mode by folding the partitions so that the foldable vertical rear plates are folded against each other; and whereby the folding display stand can be opened into a display mode by opening the vertical rear plates so that the foldable horizontal display plates are horizontal and substantially flat.

According to another aspect of the present invention there is provided a folding display stand including a plurality of vertical and radial first board elements; at least one flexible second board element connecting outer edges of at least two of the first board elements; a plurality of foldable horizontal display third board elements, each connected to at least two of the two adjacent first board elements and the second board element connecting the outer edges of the two adjacent first board elements; where the folding display stand is foldable so that the outer edges of the first board elements come close together and the third board elements are folded vertically; and where the folding display stand is circularly expansive so that the outer edges of the first board elements are spaced out and the third board elements are flattened horizontally.

According to yet another aspect of the present invention there is provided a folding display stand including a plurality of vertical boards curved or folded as a sector; a plurality of foldable horizontal display board elements, each connected one of the plurality of vertical boards; where the folding display stand is foldable so that the vertical boards are compressed together to minimize sector area and the horizontal display board elements are folded as well; and where the folding display stand is circularly expansive so that the vertical boards are spaced out to maximize sector area and the horizontal display board elements are flattened horizontally.

According to still another aspect of the present invention there is provided a folding display where at least one of the front board and the vertical board is folded outside when the folding display is compressed and folded inwardly when the folding display is expanded.

Further according to another aspect of the present invention there is provided a folding display where the vertical boards, when the folding display is expanded, form a vertically elongated cavity at the center of the folding display, the vertically elongated cavity forming a receptacle for a vertically elongated part.

Still further according to another aspect of the present invention there is provided a folding display where at least one of the vertical boards and the display boards are of different height.

Yet further according to another aspect of the present invention there is provided a folding display where at least one of the vertical boards and the display boards extend to a different distance from the center of the folding display.

Unless otherwise defined, all technical and scientific terms used herein have the same meaning as commonly understood by one of ordinary skill in the art to which this invention belongs. The materials, methods, and examples provided herein are illustrative only and not intended to be limiting. Except to the extent necessary or inherent in the processes themselves, no particular order to steps or stages of methods and processes described in this disclosure, including the figures, is intended or implied. In many cases the order of process steps may vary without changing the purpose or effect of the methods described.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF EMBODIMENTS

Figure 3:
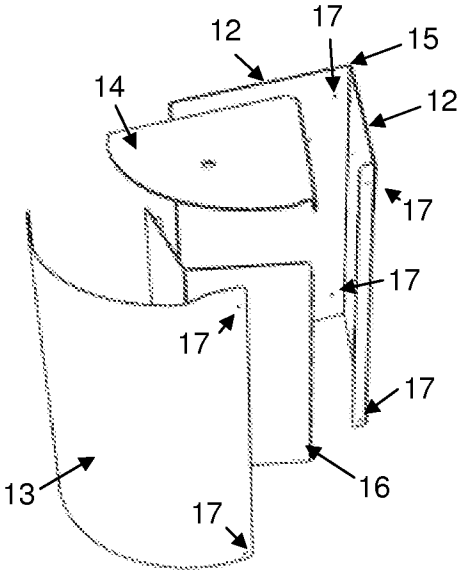
FIG. 3 is a simplified illustration of a partition of the foldable display system taken apart.

The principles and operation of a foldable display system and method according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. In addition, it is to be understood that the phraseology and terminology employed herein is for the purpose of description and should not be regarded as limiting.

In this document the term "display system" refers to a structure that includes shelves for placing articles for display and/or for sale and/or for storage. This "display system" is also called "stand", "rack", "point of sale display", "point of sale stand", etc.

The present invention includes a foldable display system made of plastic material. Typically, the display system includes one or more boards made of a plastic material. Other materials may be used too, such as for fastening, for decoration, etc. It is appreciated that plastic boards are preferred for their low cost and low weight; however, other materials may also be used.

The plastic material used is in the form of a board, or a plane or a sheet having thickness of few millimeters. The plastic material is typically polypropylene, or high impact polypropylene resin, though other materials are possible. Such plastic boards can be constructed of a plain sheet of plastic material, coated skeleton, multiwall board, etc.

Multiwall board typically includes two (or more) sheets (or surfaces) separated by a structure of spacers forming a structure of long tunnels or bores. The direction of the tunnels is named herein fiber direction. In this document the term multiwall board refers to corrugated plastic, which may also be referred to as twinwall plastic, corrugated fiberboard, multiwall structure, extruded plastic sheet, etc. as well as other combinations of these terms.

In this document, an element of a drawing that is not described within the scope of the drawing and is labeled with a numeral that has been described in a previous drawing has the same use and description as in the previous drawings. Similarly, an element that is identified in the text by a numeral that does not appear in the drawing described by the text, has the same use and description as in the previous drawings where it was described.

The drawings in this document may not be to any scale. Different Figs. may use different scales and different scales can be used even within the same drawing, for example different scales for different views of the same tag or different scales for the tag and the bag.

Figure 1:
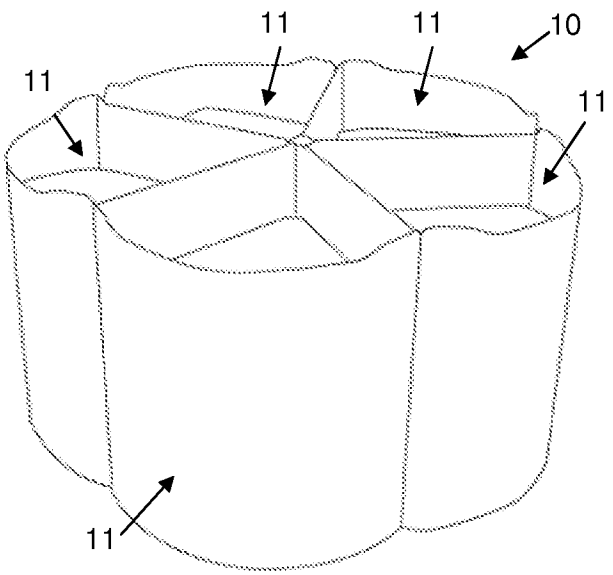
FIG. 1 is a simplified illustration of a round foldable display system made from a plurality of sector-like partitions.

Reference is now made to FIG. 1, which is a simplified illustration of a round foldable display system 10, according to one embodiment of the present invention. As seen in FIG. 1, the round foldable display system 10 includes five segments or partitions 11 arranged circularly and each partitions 11 is shaped as a sector of a circle. It is appreciated that display system 10 may include any number of partitions 11.

Figure 2:
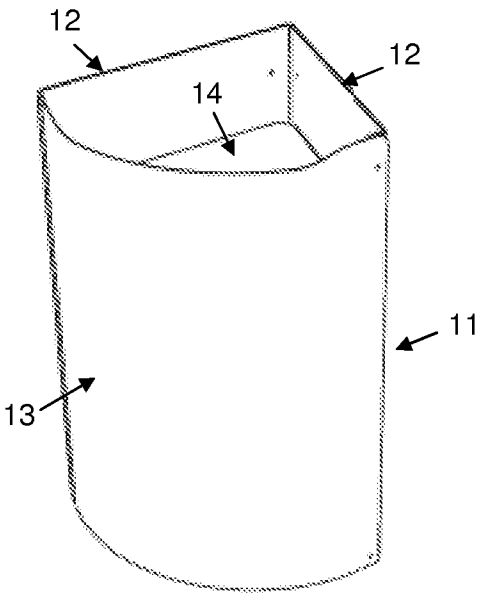
FIG. 2 is a simplified illustration of a single partition of the foldable display system.

Reference is now made to FIG. 2, which is a simplified illustration of a partition 11, according to one embodiment of the present invention.

As seen in FIG. 2, each partition 11 has two radial side plates 12, a curved, flexible, front plate 13, and a display plate 14. The side plates 12 and the front plate 13 are substantially vertical, and the display plate 14 is substantially horizontal. Items (not shown) on display are placed on the display plate 14.

Reference is now made to FIG. 3, which is a simplified illustration of a partition 11 taken apart, according to one embodiment of the present invention.

As seen in FIG. 3, the two sides plate are formed by a single board having a vertical fold 15. FIG. 3 also shows optional support part 16. As seen in FIG. 3, support part 16 may be a vertical board having a vertical fold. support part 16 is positioned below display plate 14 to support display plate 14 by transferring to the floor the weight of the items placed on display plate 14.

As seen in FIG. 3, holes 17 are typically provided to enable connecting side plates 12, front plates 13 display plates 14 and support parts 16 using appropriate builder elements such as clamps, or screws.

Figures 4A, 4B, 5A, 5B, 5C:
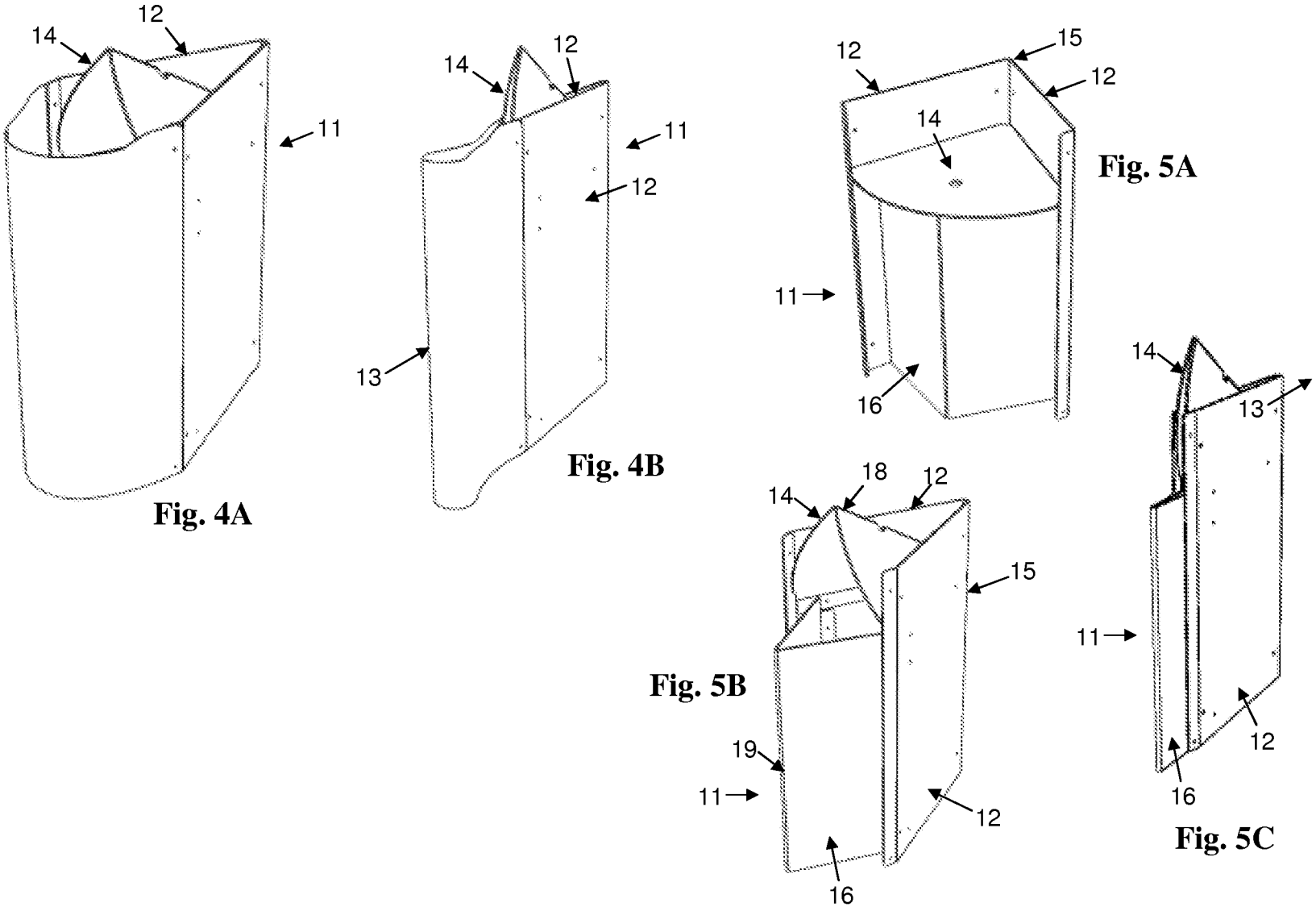
FIG. 4A is a simplified illustration of a partition partly compressed.
FIG. 4B is a simplified illustration of a partition fully compressed (closed mode, or storage mode)
FIG. 5A, FIG. 5B, and FIG. 5C are simplified illustrations of three modes of partition with the front plate removed.

Reference is now made to FIG. 4A and FIG. 4B, which are simplified illustrations of a partition 11 compressed, according to one embodiment of the present invention. FIG. 4A shows partition 11 partly compressed and FIG. 4B shows partition 11 fully compressed (closed mode, or storage mode).

Reference is now made to FIG. 5A, FIG. 5B, and FIG. 5C, which are simplified illustrations of three modes of partition 11 with the front plate 13 removed, according to one embodiment of the present invention.

FIG. 5A shows partition 11 in open mode or display mode. FIG. 5B shows partition 11 partly compressed, and FIG. 5C shows partition 11 fully compressed. As seen in FIG. 5B, display plate 14 has a fold 18, and support part 16 has a fold 19. It is appreciated that folds 15, 18 and 19 enables the folding of the board making the side plates 12, the display plate 14, and the support part 16, respectively. As seen in 4A and FIG. 4B, the front plate 13 typically bends.

It is appreciated that when partition 11 is folded into closed mode the outer edges, or side plates 12 come close together and display plate 14 is folded vertically. It is appreciated that when partition 11 is folded into closed mode the vertical boards including the side plates 12 and support part 16 are compressed together to minimize the sector area of partition 11.

It is appreciated that when partition 11 is expanded into open mode the outer edges, or side plates 12 are spaced out and said the display plate 14 is flattened horizontally. Therefore, the open mode maximizes the sector area of partition 11.

Figure 6A:
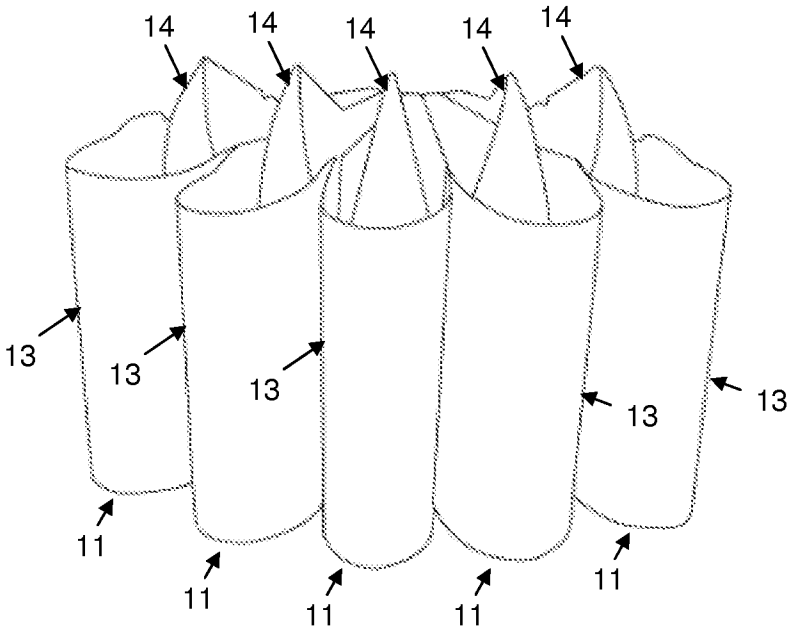
FIG. 6A and FIG. 6B are simplified illustration of round foldable display system in compressed modes.
Figure 6B:
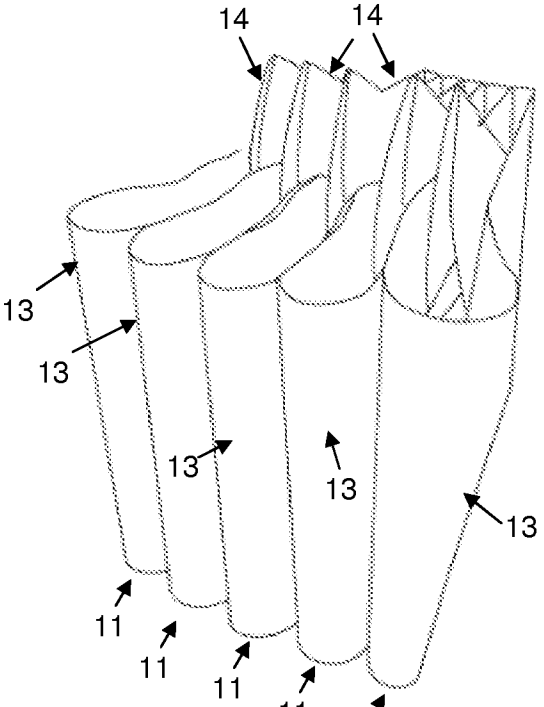

Reference is now made to FIG. 6A and FIG. 6B, which are simplified illustration of round foldable display system 10 in compressed modes, according to one embodiment of the present invention. FIG. 6A shows display system 10 in partially compressed mode, and FIG. 6B shows display system 10 in fully compressed mode.

Figure 9:
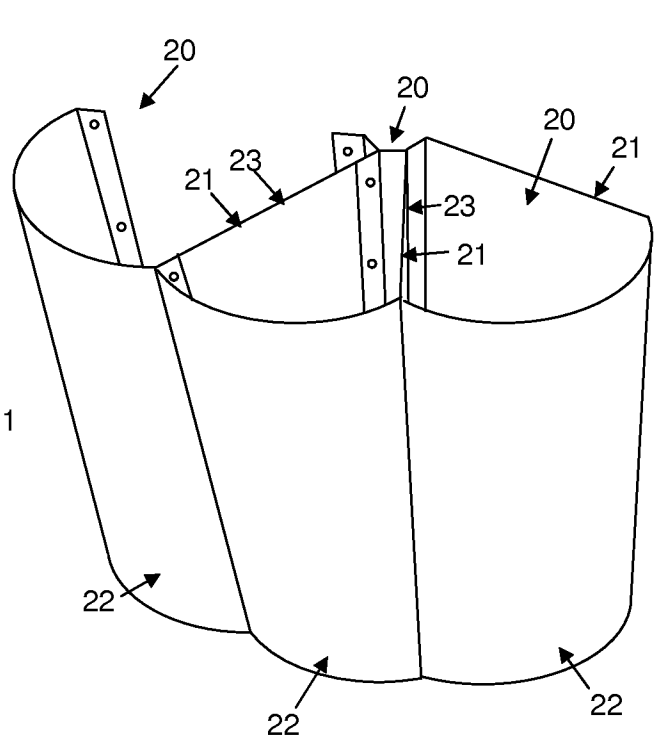
FIG. 9 is a simplified illustration of three single side wall partitions connected together.
Figure 8:
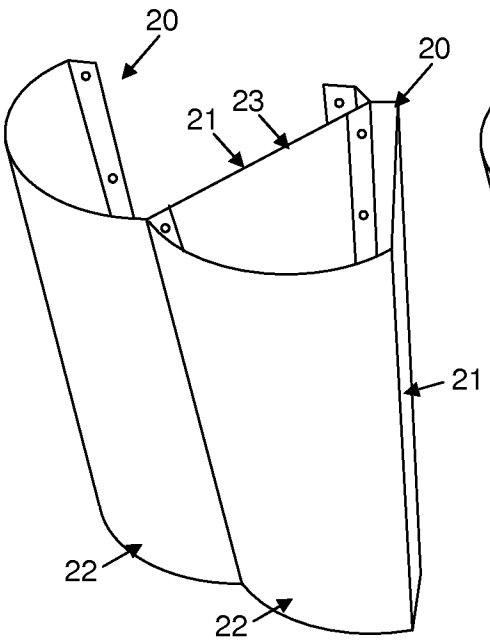
FIG. 8 is a simplified illustration of two single side wall partitions connected together.
Figure 7:
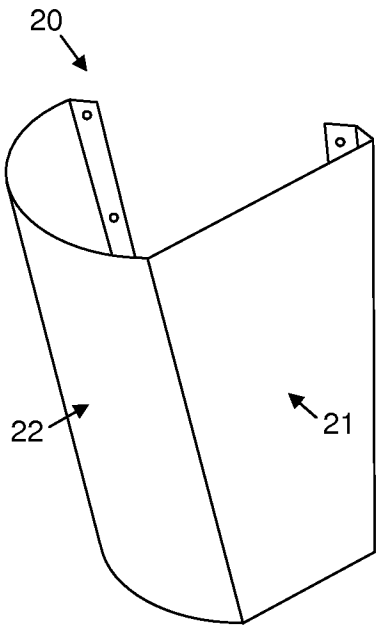
FIG. 7 is a simplified illustration of a single side wall partition.

Reference is now made to FIG. 7, FIG. 8, and FIG. 9, which are simplified illustrations of a one, two and three single side wall partitions 20, respectively, according to one embodiment of the present invention.

Partition 20 is a part of a round foldable display system 10, similarly to partition 11. However, when connecting together a plurality of partitions 20, each partition provides a radial wall 21 to the adjacent partition. As seen in FIGS. 7, 8 and 9, each partition includes a single board that includes the radial wall 21 (similar to the side plates 12 of FIGS. 1-6B) and a front wall 22 (similar to the front plate 13 of FIGS. 1-6B). Partition 20 may also include a display plate and its support part (not shown in FIGS. 7-9, but similar to the display plate 14 and support part 16 of FIGS. 1-6B).

FIG. 8 shows two partitions 20 connected together so that wall 21 of one partition 20 (designated by numeral 23) serves as the second side or radial wall or plate of the other partition 20. FIG. 9 shows three partitions 20 connected together so that wall 21 (designated by numeral 23) of each partition 20 serves as the second side or radial wall or plate of the adjacent partition 20. It is appreciated that the partitions 20 can be further connected in this way to create a full circle such as in FIG. 1.

Figure 10A:
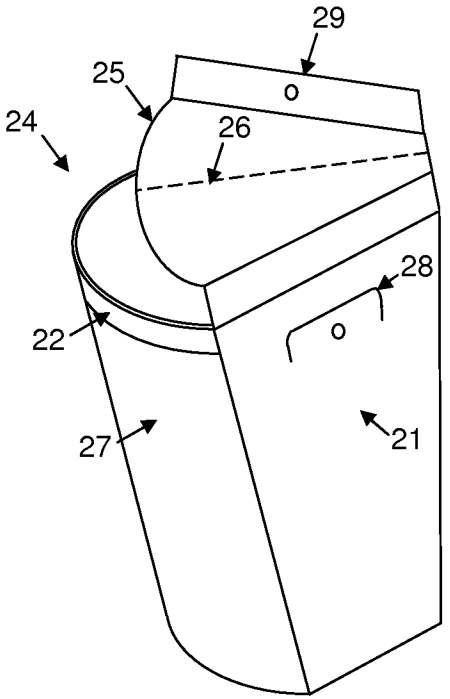
FIG. 10A, 10B, 10C are simplified illustrations of three views of a single-board partition.
Figure 10B:
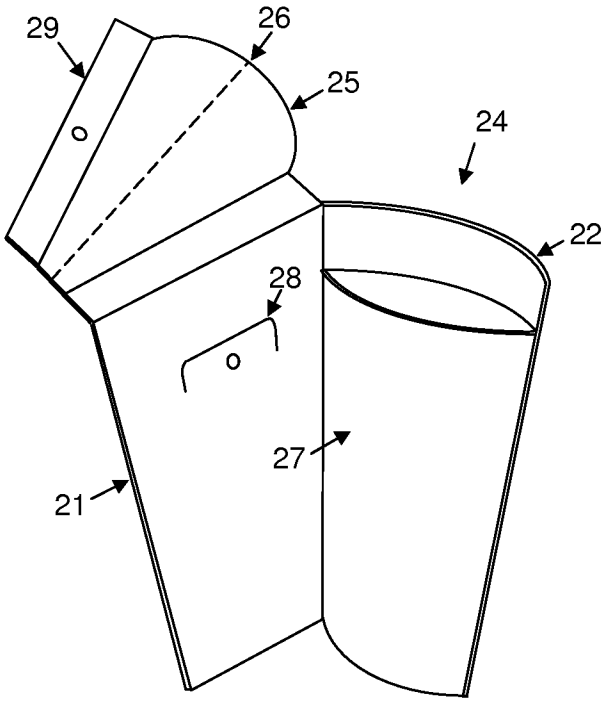
Figure 10C:
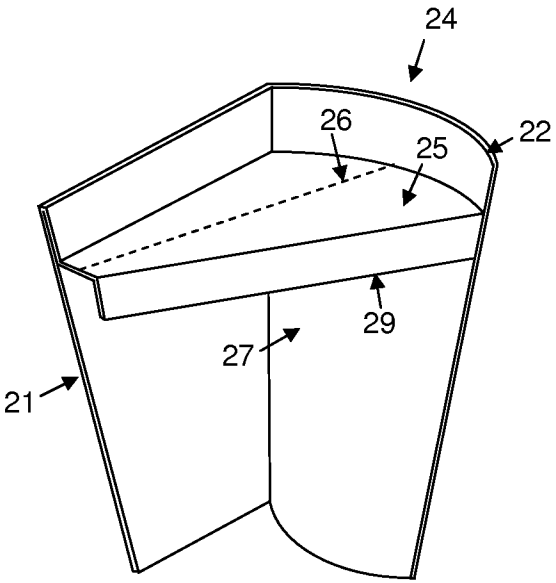

Reference is now made to FIG. 10A, 10B, 10C, which are simplified illustrations of three views of a single-board partition 24, according to one embodiment of the present invention.

Partition 24 is a part of a round foldable display system 10, similarly to partition 20 or partition 11, however, containing a single board that functions as a radial wall, a front wall, a display plate, and a support part.

FIG. 10A shows a partition 24 having a side (radial) wall 21, and a front wall 22, similar to partition 20. Partition 24 also includes a display plate 25 foldable along fold 26, and a support part 27, typically extending below front wall 22. A receptacle part 28 is typically provided in the side wall to accept and retain in place tab 29 of display plate 25.

FIG. 10C shows partition 24 with support part 27 curved inwards to provide support for the display pate 25. FIG. 10C shows partition 24 with display plate 25 folded down to provide a horizontal plate suited for displaying or storing elements on display.

Figure 12:
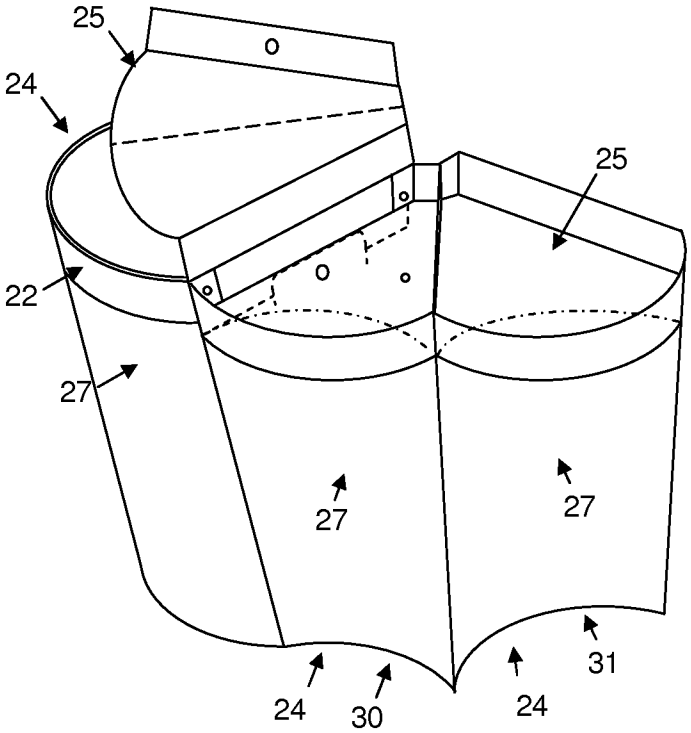
FIG. 12 is a simplified illustration of three single-board partitions connected together.
Figure 11:
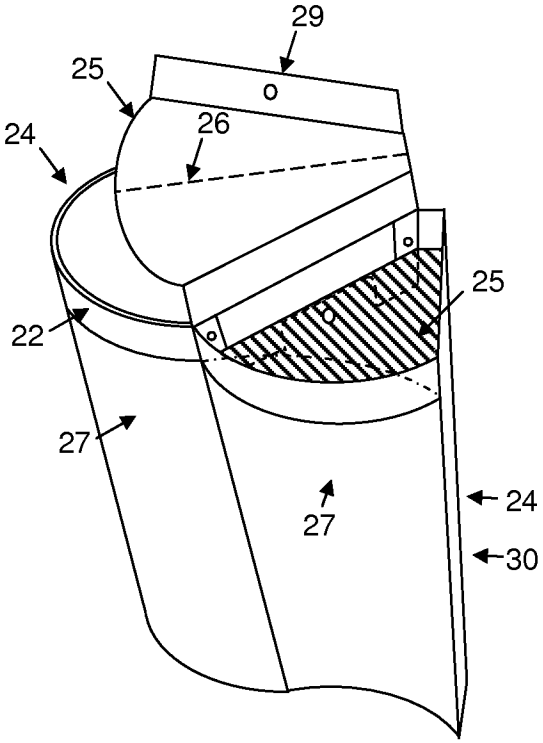
FIG. 11 is a simplified illustration of two single-board partitions connected together.

Reference is now made to FIG. 11, and FIG. 12, which are simplified illustrations of two and three single-board partitions 24 connected together, according to one embodiment of the present invention.

FIG. 11 shows two partitions 24 connected together, similar to FIG. 8. As seen in FIG. 11, partition 24 at the right (designated by numeral 30) has its display plate 25 folded in place and support plate 27 curved inward to support display plate 25.

FIG. 12 shows three partitions 24 connected together, similar to FIG. 9. As seen in FIG. 12, the two partitions 24 at the right (designated by numerals 30 and 31) have their display plates 25 folded in place and support plates 27 curved inward to support the display plates 25. It is appreciated that more partitions 24 can be added to form a complete circle. It is appreciated that support plates 27 can be folded inward instead of curved inwards.

Figure 13:
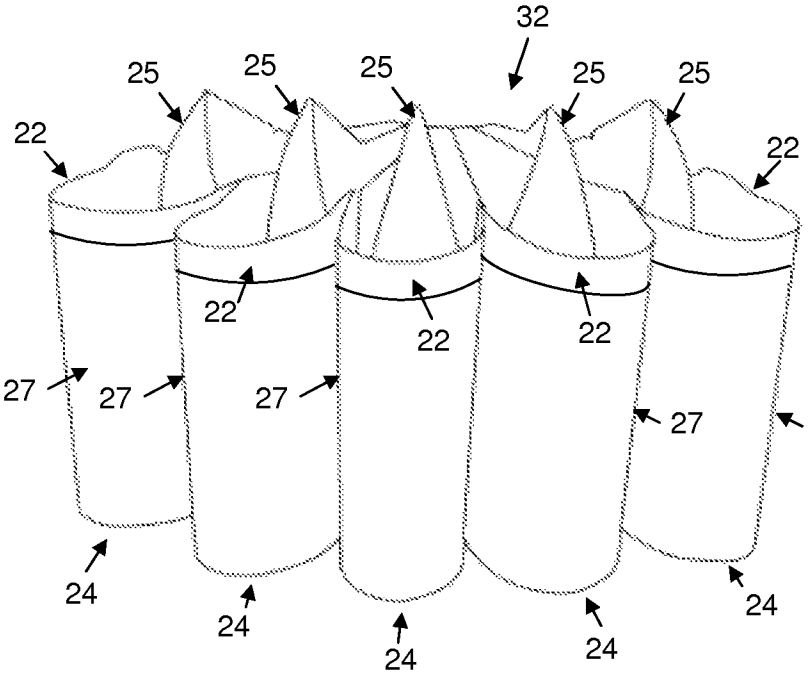
FIG. 13 is a simplified illustration of a foldable display system made from a plurality of single-board partitions.

Reference is now made to FIG. 13, which is a simplified illustration of a foldable display system 32 made from a plurality of partitions 24, according to one embodiment of the present invention.

As seen in FIG. 13, foldable display system 32 is shown in partially compressed mode, with the radial side walls 21 (not shown) close together, with front walls 22 and support parts 27 pressed outside, and with display pates 25 folded upwards.

Figure 14:
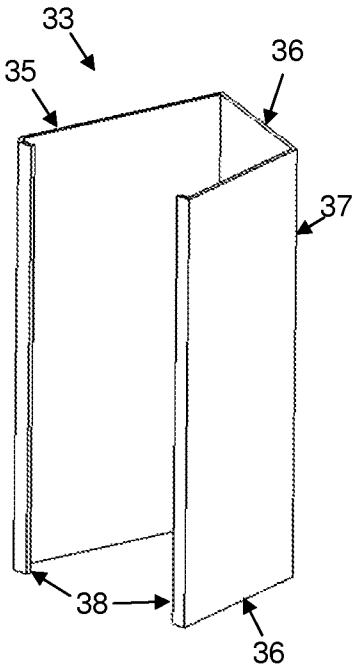
FIG. 14 is a simplified illustration of a foldable front wall partition.
Figure 15:
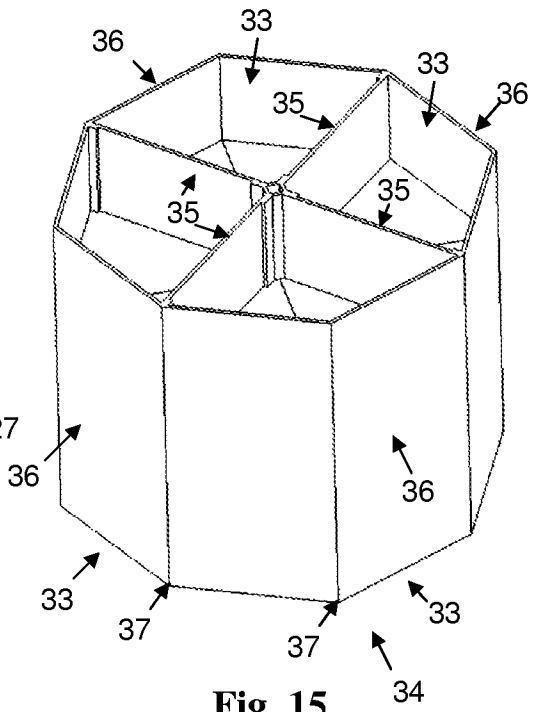
FIG. 15 which is a simplified illustration of a foldable octagonal display system 1 made from a plurality of foldable front wall partitions.

Reference is now made to FIG. 14, which is a simplified illustration of a foldable front wall partition 33, and FIG. 15 which is a simplified illustration of a foldable octagonal display system 34 made from a plurality of partitions 33, according to one embodiment of the present invention.

As seen in FIG. 14, partition 33 includes one radial side wall 35 and a front wall 36, similar to partition 24, however, front wall 36 is flat and foldable at fold 37 (instead of being round and flexible as in partition 24). Partitions 33 can be connected to each other using connecting parts 38, to form a display system. As seen in FIG. 15, four partitions 33 are joined together to form octagonal display system 34.

It is appreciated that any number of sector-shaped partitions 33, or 24, or 11, can be joined to form a circular collapsible display system providing circularly, or radially, arranged display partitions, which can be compressed to preserve space or volume.

It is therefore appreciated that a folding display stand such as display system 10 includes a plurality of folding partitions such as partitions 11, 20, or 24 described above. Each partition typically includes:

- a foldable vertical rear plate, such as plate (or wall) 12, or 21;
- a flexible vertical front plate, such as plate (or wall) 13, or 23; and
- a foldable horizontal display plate, such as plate 14, or 25.

Optionally, each partition also includes a support part, such as 16 or 29.

The partitions are joined side-by-side by their vertical rear plates so that the folding display stand can be compressed into a storage mode by folding the partitions so that said foldable vertical rear plates are folded against each other. Additionally, the folding display stand can be opened into a display mode by opening or expanding the vertical rear plates so that the foldable horizontal display plates are horizontal and substantially flat.

Alternatively, the folding display stand includes:

a plurality of vertical and radial first board elements, such as plate (or wall) 12, or 21;

at least one flexible second board element connecting outer edges of at least two of said first board elements and forming the flexible vertical front plates described above;

a plurality of foldable horizontal display third board elements forming the display plates described above. Each such third board element is connected to at least two of its adjacent first and second board elements, thus connecting the outer edges of the two adjacent first board elements.

This folding display stand is circularly foldable (compressed) so that the outer edges of the first board elements come close together and the third board elements are folded vertically.

Alternatively, this folding display stand is circularly expansive (opened), so that said outer edges of said first board elements are spaced out and the third board elements are flattened horizontally.

Alternatively, the folding display stand includes:

a plurality of vertical boards curved or folded as a sector; and a plurality of foldable horizontal display board elements, each connected to at least one of the plurality of vertical boards;

Alternatively, the folding display stand is foldable so that the vertical boards are compressed together to minimize the sector area and the horizontal display board elements are folded as well.

Alternatively, the folding display stand is circularly expansive so that the vertical boards are spaced out to maximize sector area and said horizontal display board elements are flattened horizontally.

It is noted that the terms board, plate, and sheet may be used interchangeably.

Figure 16B:
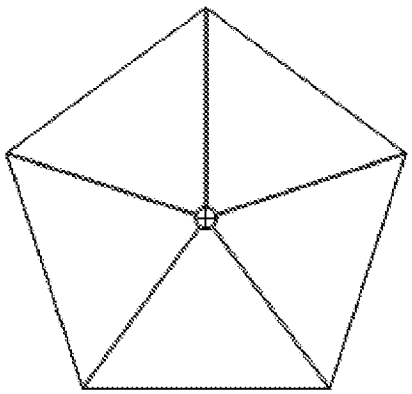
FIG. 16A and FIG. 16B are a simplified isometric view and an upper view, respectively, of a polygonal folding display stand.
Figure 16A:
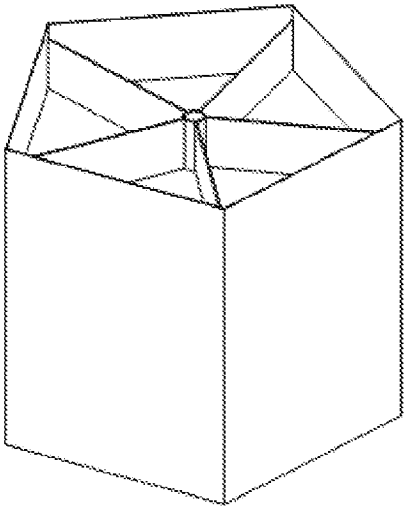

Reference is now made to FIG. 16A and FIG. 16B, which are a simplified isometric view and an upper view, respectively, of a polygonal folding display stand according to another embodiment of the present invention.

Figure 17B:
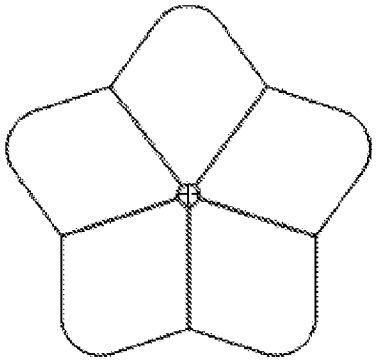
FIG. 17A and FIG. 17B are a simplified isometric view and an upper view, respectively, of an outwardly curved folding display stand.
Figure 17A:
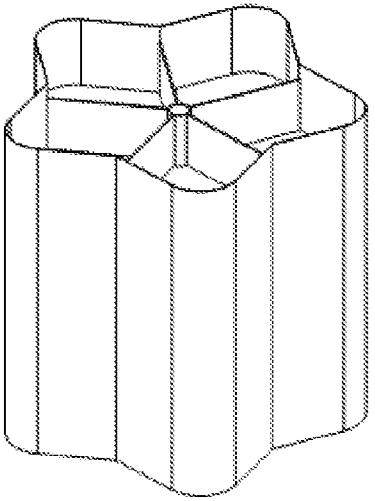

Reference is now made to FIG. 17A and FIG. 17B, which are a simplified isometric view and an upper view, respectively, of an outwardly curved folding display stand according to another embodiment of the present invention.

Figure 18B:
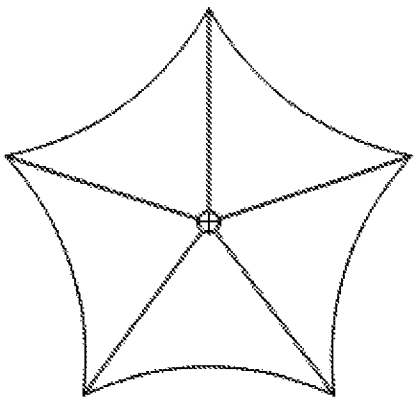
FIG. 18A and FIG. 18B are a simplified isometric view and an upper view, respectively, of an inwardly curved folding display stand.
Figure 18A:
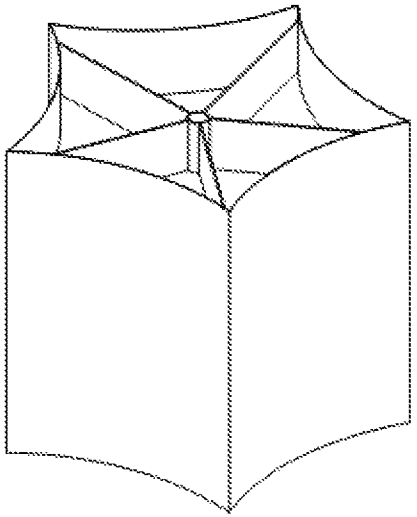

Reference is now made to FIG. 18A and FIG. 18B, which are a simplified isometric view and an upper view, respectively, of an inwardly curved folding display stand according to another embodiment of the present invention.

Figure 19B:
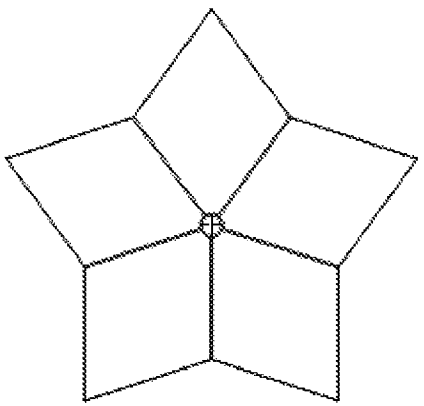
FIG. 19A and FIG. 19B are a simplified isometric view and an upper view, respectively, of a star-shaped folding display stand.
Figure 19A:
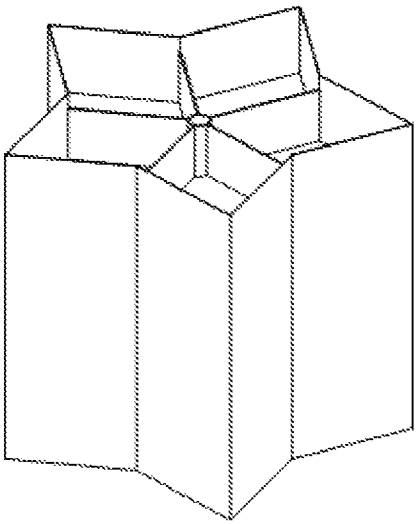

Reference is now made to FIG. 19A and FIG. 19B, which are a simplified isometric view and an upper view, respectively, of a star-shaped folding display stand according to another embodiment of the present invention.

Figure 20A:
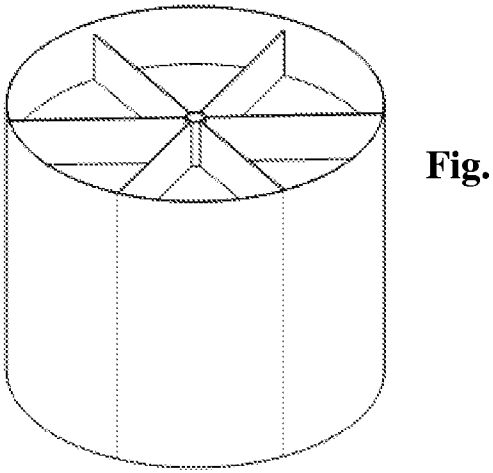
FIG. 20A and FIG. 20B are a simplified isometric view and an upper view, respectively, of a round folding display stand.
Figure 20B:
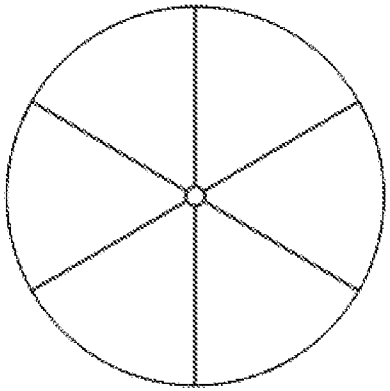

Reference is now made to FIG. 20A and FIG. 20B, which are a simplified isometric view and an upper view, respectively, of a round folding display stand according to another embodiment of the present invention.

Figure 21A:
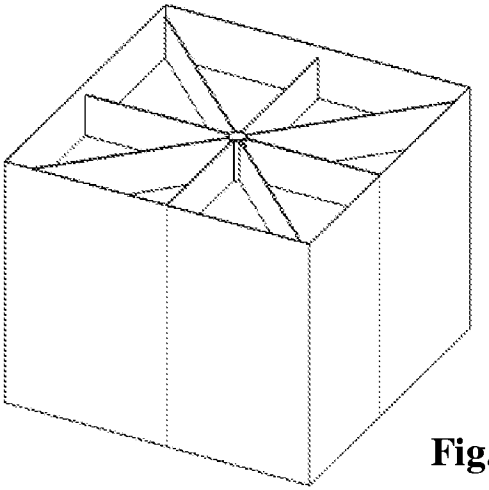
FIG. 21A and FIG. 21B are a simplified isometric view and an upper view, respectively, of a square folding display stand.
Figure 21B:
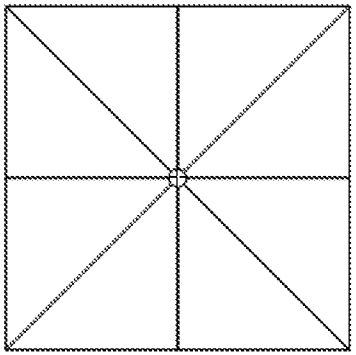

Reference is now made to FIG. 21A and FIG. 21B, which are a simplified isometric view and an upper view, respectively, of a square folding display stand according to another embodiment of the present invention.

Figure 22A:
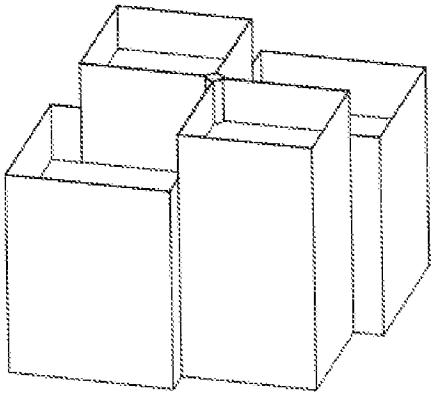
FIG. 22A and FIG. 22B are a simplified isometric view and an upper view, respectively, of a multi-leveled square folding display stand.
Figure 22B:
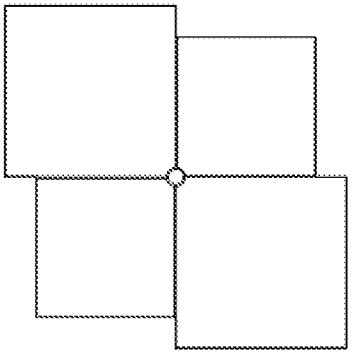

Reference is now made to FIG. 22A and FIG. 22B, which are a simplified isometric view and an upper view, respectively, of a multi-leveled square folding display stand according to another embodiment of the present invention.

Figure 23A:
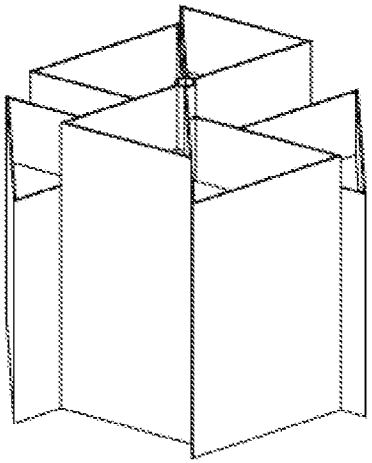
FIG. 23A and FIG. 23B are a simplified isometric view and an upper view, respectively, of a multi-leveled triangular folding display stand.
Figure 23B:
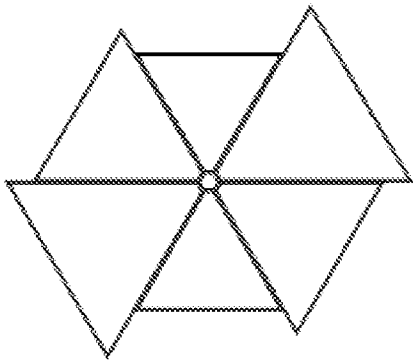

Reference is now made to FIG. 23A and FIG. 23B, which are a simplified isometric view and an upper view, respectively, of a multi-leveled triangular folding display stand according to another embodiment of the present invention.

Figure 24A:
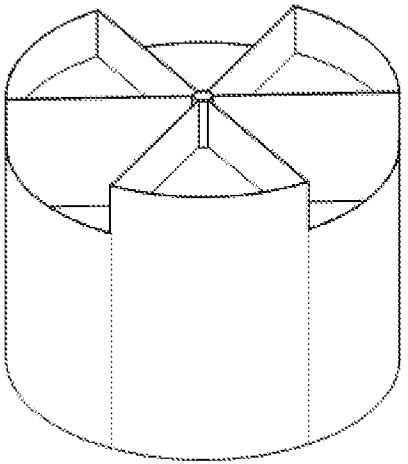
FIG. 24A and FIG. 24B are a simplified isometric view and an upper view, respectively, of a multi-leveled round folding display stand.
Figure 24B:
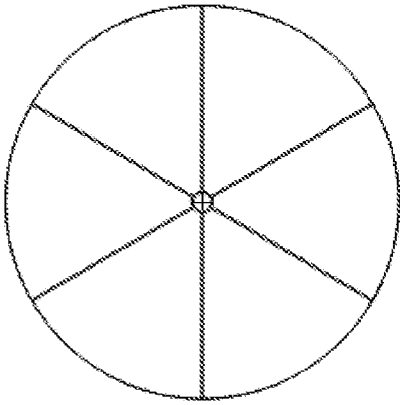

Reference is now made to FIG. 24A and FIG. 24B, which are a simplified isometric view and an upper view, respectively, of a multi-leveled round folding display stand according to another embodiment of the present invention.

Figure 25A:
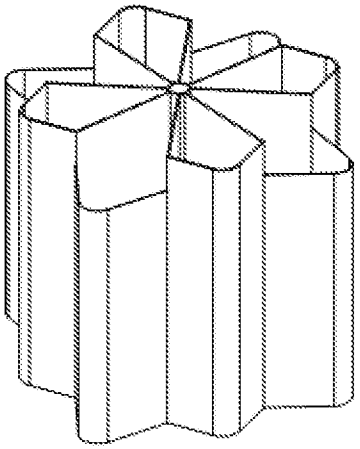
FIG. 25A and FIG. 25B are a simplified isometric view and an upper view, respectively, of a multi-leveled star-shaped folding display stand.
Figure 25B:
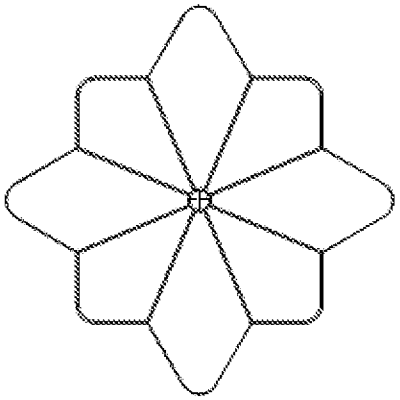

Reference is now made to FIG. 25A and FIG. 25B, which are a simplified isometric view and an upper view, respectively, of a multi-leveled star-shaped folding display stand according to another embodiment of the present invention.

Figure 26B:
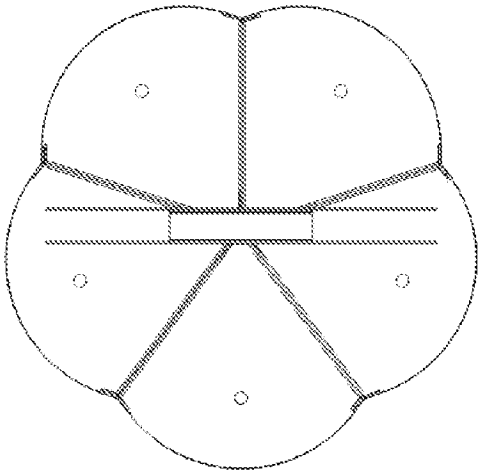
FIG. 26A and FIG. 26B are a simplified isometric view and an upper view, respectively, of a crowned folding display stand.
Figure 26A:
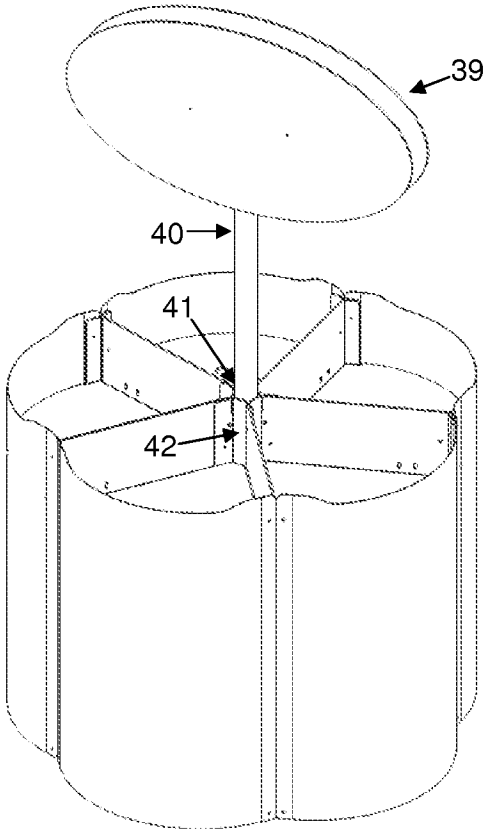

Reference is now made to FIG. 26A and FIG. 26B, which are a simplified isometric view and an upper view, respectively, of a crowned folding display stand according to another embodiment of the present invention. As seen in FIG. 26A, the crowned folding display has a crown part 39 mounted on a rod 40 (vertically elongated part) inserted in a receptacle 41 (vertically elongated cavity) formed by the unfolding or expansion of the folding display. Particularly, by the unfolding or expansion of the vertical boards of the folding display. As seen in FIG. 26A, as well as in many of the previous Figs., each sector of the folding display includes a central vertical part 42. When the folding display is unfolded or expanded the central vertical parts form the central cavity 41.

It is appreciated that the folding displays of FIGS. 16A to 26B all use the methods and components as described with reference to FIGS. 1 to 15, with the necessary modifications as required to achieve the particular shape of each embodiment.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A folding display stand comprising:

a plurality of folding partitions, each partition comprising:

a foldable vertical rear board;

a flexible vertical front board; and a foldable horizontal display board;

wherein said partitions are joined side-by-side by their vertical rear boards;

whereby a display mode of the folding display stand can be compressed while in said display mode into a compressed storage mode by folding said partitions so that said foldable vertical rear boards are folded against each other; and whereby said compressed storage mode of the folding display stand can be re-opened into said display mode by decompressing said vertical rear boards so that said foldable horizontal display boards are horizontal and substantially flat.

2. A folding display stand according to claim 1 wherein at least one of said flexible vertical front board and foldable vertical rear board is folded outside when said display mode of said folding display stand is compressed into said compressed storage mode and folded inwardly when said display mode of said folding display stand is expanded.

3. A folding display stand according to claim 1 wherein said vertical boards, when said display mode of said folding display stand is expanded, form a vertically elongated cavity at the center of said folding display stand, said vertically elongated cavity forming a receptacle for a vertically elongated part.

4. A folding display stand according to claim 1 wherein at least one of said vertical boards and said display boards are of different height.

5. A folding display stand according to claim 1 wherein at least one of said vertical boards and said display boards extend to a different distance from the center of said folding display stand.

6. A folding display stand comprising:

a plurality of vertical and radial first board elements;

at least one flexible second board element connecting outer edges of at least two of said first board elements;

a plurality of foldable horizontal display third board elements, each connected to at least two of said two adjacent first board elements and said second board element connecting said outer edges of said two adjacent first board elements;

wherein said folding display stand is foldable while in a display mode so that said outer edges of said first board elements come close together and said third board elements are folded vertically; and wherein said folding display stand is circularly expansive into said display mode from a compressed storage mode so that said outer edges of said first board elements are spaced out and said third board elements are flattened horizontally.

7. A folding display stand according to claim 6 wherein at least one of said vertical first board element and radial first board element is folded outside when said display mode of said folding display stand is compressed into said compressed storage mode and folded inwardly when said compressed storage mode of said folding display stand is expanded into said display mode.

8. A folding display stand according to claim 6 wherein said vertical first board elements, when said folding display stand is expanded into said display mode, form a vertically elongated cavity at the center of said folding display stand, said vertically elongated cavity forming a receptacle for a vertically elongated part.

9. A folding display stand according to claim 6 wherein at least one of said vertical first board elements and said horizontal display third boards are of different height.

10. A folding display stand according to claim 6 wherein at least one of said vertical first board elements and said horizontal display third boards extend to a different distance from the center of said folding display stand.

11. A folding display stand comprising:

a plurality of front and radial vertical boards curved or folded as a sector;

a plurality of foldable horizontal display board elements, each connected to one of said plurality of said vertical boards;

wherein a display mode of said folding display stand is foldable into a compressed mode so that said vertical boards are compressed together to minimize sector area and said horizontal display board elements are folded as well; and wherein said display mode of said folding display stand is circularly expansive so that said vertical boards are spaced out to maximize sector area and said horizontal display board elements are flattened horizontally.

12. A folding display stand according to claim 11 wherein at least one of said front and radial vertical board is folded outside when said display mode of said folding display stand is compressed into said compressed storage mode and folded inwardly when said compressed storage mode of said folding display stand is expanded into said display mode.

13. A folding display stand according to claim 11 wherein said front and radial vertical boards, when said compressed storage mode of said folding display stand is expanded, form a vertically elongated cavity at the center of said folding display stand, said vertically elongated cavity forming a receptacle for a vertically elongated part.

14. A folding display stand according to claim 11 wherein at least one of said vertical boards and said display boards are of different height.

15. A folding display stand according to claim 11 wherein at least one of said vertical boards and said display boards extend to a different distance from the center of said folding display.

16. A folding display stand comprising:

a plurality of foldable sectors, wherein all the sectors are positioned vertically and are foldable horizontally, and wherein each sector comprises:

at least one vertical radial board;

at least one foldable vertical front board; and a horizontal foldable display board;

wherein at least one of said radial board and front board are foldable to provide support to said display board, and wherein said folding display stand is circularly compressible to form a compressed storage mode and circularly expansive to form a display mode.

17. A folding display stand according to claim 16 wherein at least one of said vertical front board and vertical radial board is folded outside when said folding display stand is compressed into said compressed storage mode and folded inwardly when said folding display is expanded into said display mode.

18. A folding display stand according to claim 16 wherein said vertical boards, when said compressed storage mode of said folding display stand is expanded into said display mode, form a vertically elongated cavity at the center of said folding display stand, said vertically elongated cavity forming a receptacle for a vertically elongated part.

19. A folding display stand according to claim 16 wherein at least one of said vertical front and radial boards and said horizontal display boards are of different height.

20. A folding display stand according to claim 16 wherein at least one of said vertical front and radial boards and said horizontal display boards extend to a different distance from the center of said folding display stand.

* * * * *